US006182437B1

(12) United States Patent
Prociw

(10) Patent No.: US 6,182,437 B1
(45) Date of Patent: Feb. 6, 2001

(54) FUEL INJECTOR HEAT SHIELD

(75) Inventor: Lev Alexander Prociw, Elmira (CA)

(73) Assignee: Pratt & Whitney Canada Corp., Longueuil (CA)

( * ) Notice: Under 35 U.S.C. 154(b), the term of this patent shall be extended for 0 days.

(21) Appl. No.: 09/339,386

(22) Filed: Jun. 24, 1999

(51) Int. Cl.[7] ..... F02C 3/00
(52) U.S. Cl. ..... 60/39.06
(58) Field of Search ..... 60/39.06, 740, 60/734, 39.02, 39.32; 29/890.1

(56) References Cited

U.S. PATENT DOCUMENTS

| | | | | |
|---|---|---|---|---|
| 4,735,044 | | 4/1988 | Richey et al. . | |
| 5,231,833 | | 8/1993 | MacLean et al. . | |
| 5,269,468 | | 12/1993 | Adiutori . | |
| 5,598,696 | | 2/1997 | Stotts . | |
| 5,761,907 | * | 6/1998 | Pelletier et al. | 60/740 |
| 6,076,356 | * | 6/2000 | Pelletier | 60/740 |

* cited by examiner

*Primary Examiner*—Timothy S. Thorpe
*Assistant Examiner*—William Rodriguez
(74) *Attorney, Agent, or Firm*—Jeffrey W. Astle

(57) ABSTRACT

The invention relates to a method of inhibiting instability during operation of a gas turbine engine, where the instability is due to the uncontrolled interaction between the air filled gap defined by a heat shield and a fuel passage in a conventional fuel injector. The invention is a method of pre-treating the fuel injectors to form a precipitant, such as coke, within the insulating air gap in a controlled and predictable manner prior to installation of the injector into the engine. In this way, the precipitant is present on initial engine operation and impedes the flow of air and fuel within the gap, thus substantially reducing or eliminating engine instability. The method involves filling an annular portion of the gap with a selected fluid, such as hydrocarbon fuel for example, and then curing the liquid to form a precipitant, such as coke, that remains physically and chemically stable at temperatures within the temperature operating range of the injector stem and that permits relative thermally induced movement between the heat shield and the fuel passage. The inventor has recognized that engine instability at low power levels in particular (known as engine "hooting") is caused by the pressurized fuel interacting with a trapped volume of air in the gap which is conventionally used as an insulator between the fuel injector heat shield and the fuel passage in the fuel injector stem.

10 Claims, 2 Drawing Sheets

FUEL INJECTOR HEAT SHIELD

TECHNICAL FIELD

The invention is directed to a method of inhibiting or completely preventing instability during operation of a gas turbine engine, instability being due to the uncontrolled interaction between the air filled gap defined by a heat shield and a fuel passage in a conventional fuel injector, particularly during low power operation.

BACKGROUND OF THE ART

The invention relates to a method of inhibiting instability during operation of a gas turbine engine, where the instability is due to the uncontrolled interaction between the air filled gap defined by a heat shield and a fuel passage in a conventional fuel injector.

Conventional fuel control systems are designed on the assumption that the fuel is incompressible and flows through a fixed volume conduit system to the injector tips. Therefore fuel control is based on supplying a known volume of incompressible fuel during a known time period.

The inventor has recognized that engine instability at low power levels in particular (known as engine "hooting") is caused by the pressurized fuel interacting with a trapped volume of air in a gap which is conventionally used as an insulator between a fuel injector heat shield and a fuel passage in the fuel injector stem.

The trapped air is compressed and decompressed when fuel pressure changes, and fuel stored in the gap is released in an uncontrolled manner resulting in engine instability.

Conventionally a gas turbine engine includes an elongate fuel injector having an injector stem with an internal fuel passage extending from an engine mount end to an injector tip at a discharge end. The stem includes a tubular internal heat shield disposed within the fuel passage. The heat shield is secured to the fuel passage adjacent the mount end of the stem and spaced inwardly from the fuel passage thus defining an elongate annular thermal insulating gap between the fuel passage and the heat shield.

The air filled gap is open to the fuel passage since it is necessary to permit relative thermally induced movement between the heat shield and the fuel passage. The heat shield is cooled by the flow of relatively cool fuel whereas the fuel injector stem is relatively hot due to the temperature of the surrounding ambient compressed air. To date, the presence of this open air-filled insulating gap has not been considered as problematic, since the assumption has been that coke will quickly form to plug the opening during initial operation. However, it is the timing of coke formation and the unpredictable performance of the coke plug which causes engine instability on initial operation and can result in premature coking of the fuel injector tips.

The air-filled gap causes engine instability since the entrapped insulating air is compressed when pressurised fuel is injected through the fuel passage. The compressed air has less volume and a volume of fuel occupies the area of the air gap from which air has retreated. As a result, the total volume of fuel delivered to the injector tip is less than the volume which the fuel control system records as delivered. When the fuel control reduces fuel pressure, the air within the gap is decompressed and the entrapped fuel within the gap escapes to be delivered to the fuel injectors.

The removal of a volume of fuel when fuel pressure increases and subsequent delivery of fuel when fuel pressure decreases, is the cause of engine instability when such air gaps are used in conjunction with a fuel injector heat shield, especially on initial operation of the engine at low power conditions. After the engine has been in operation for a sufficient time, some of the fuel entrapped within the air gap eventually decomposes due to the temperature of the surrounding fuel stem. Coke deposits form to plug the gap impeding the movement of air and fuel. However, during the initial operation of the engine, the noise and erratic operation of the engine prior to coke formation causes concern to purchasers and the engines are often unnecessarily returned to the manufacturer to investigate the cause of this instability.

The uncontrolled formation of coke and the uncontrolled fuel/air interface within the air gap can cause further fuel system problems. Uncontrolled coke formation within a limited area, combined with the inflow and outflow of fuel within the gap can dislodge coke and cause agglomerations of coke to travel from the gap to the fuel injector tip and spray nozzles. Such movement of coke particles can lead to premature formation of coke in the injector tip and plugging of fuel spray nozzles.

When coke is permitted to form in an uncontrolled and unmeasured manner within the gap, the coke may not adhere firmly to the gap walls or fuel may only partially decompose resulting in undesirable movement of coke particles from the gap to other fuel system components downstream.

The uncontrolled fuel/air interface creates volatile gas within the insulating gap when high engine temperatures cause evaporation of the fuel. The volatile gas may decompose and form coke, however since engine operating temperatures may vary, the ultimate result is unclear. However, the presence of a volatile gas confined in a heated environment is undesirable especially since this gas does nothing to enhance engine performance.

In some situations it is best to merely discontinue use of air-filled insulating gaps in fuel injectors such as in newly manufactured engines. Due to continuing use of such heat shields in existing engines, the disadvantages of use do not overcome the cost of replacement or redesign, and the difficulties described above continue.

It is an object of the invention to prevent engine instability and to control the fuel/air interface where use of air-filled gaps remain.

Further objects of the invention will be apparent from review of the disclosure and description of the invention below.

DISCLOSURE OF THE INVENTION

The invention is a method of pre-treating the fuel injectors to form a precipitant, such as coke, within the insulating air gap in a controlled and predictable manner prior to installation in the engine. In this way, the precipitant is present on initial engine operation and impedes the flow of air and fuel within the gap, thus substantially reducing or eliminating the engine instability.

The method involves filling an annular portion of the gap with a selected liquid, such as hydrocarbon fuel for example, and then curing the liquid to form a precipitant, such as coke, that remains physically and chemically stable at temperatures within an operating range for the injector stem and that permits relative thermally induced movement between the heat shield and the fuel passage.

The fuel can be heated by placing the fuel injector stem in an oven or by induction heating of the fuel injector stem. Preferably, the fuel passage is purged of fuel with a continuous flow of cool dry air during heating of the fuel. To form coke, the fuel is heated to a temperature in the range of 150° C. to 750° C. for a time duration in the range of 20 to 120 minutes.

Further details of the invention and its advantages will be apparent from the detailed description and drawings included below.

BRIEF DESCRIPTION OF THE DRAWINGS

In order that the invention may be readily understood, one preferred embodiment of the invention will be described by way of example, with reference to the accompanying drawings wherein.

DETAILED DESCRIPTION OF PREFERRED EMBODIMENTS

Figure 1:
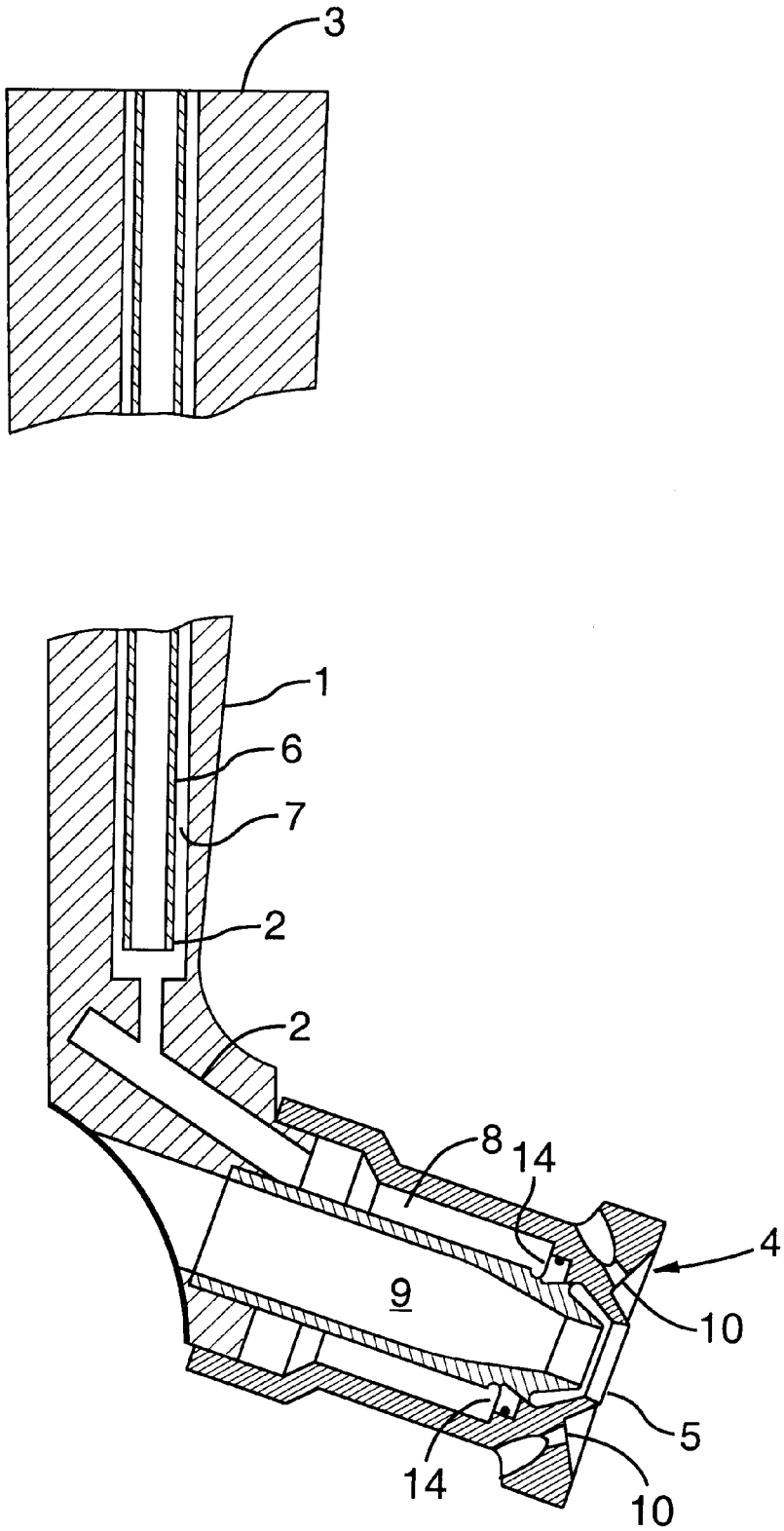
FIG.1 PRIOR ART
FIG. 1 is a longitudinal cross-sectional view through a conventional fuel injector used in a gas turbine engine including an injector tip at the discharge end and an elongate stem with a tubular internal heat shield disposed within the fuel passage and spaced inwardly from the fuel passage thus defining an elongate annular air-filled thermal insulating gap between the fuel passage and the tubular heat shield.

FIG. 1 illustrates a longitudinal sectional view through a conventional fuel injector by which fuel is conveyed to the injector tip and sprayed into the combustor of the engine. Gas turbine engines include several elongate fuel injectors each having an injector stem 1 with an internal fuel passage 2 extending from an engine mount end 3 to an injector tip 4 at a discharge end 5.

The injector stem 1 includes a tubular internal heat shield 6 disposed within the fuel passage 2. The heat shield 6 is secured to the fuel passage, by brazing for example, adjacent the mount end 3 and is spaced inwardly from the fuel passage 2 thus defining an elongate annular thermal insulating gap 7 between the fuel passage and the heat shield 6. The insulating gap 7 is used to thermally isolate the relatively hot injector stem 1 disposed within a flow of hot compressed air in the engine and the relatively cool fuel conducted through the heat shield 6 and fuel passage 2 into a plenum 8 in a downward direction as drawn in FIG. 1.

The pressurized fuel from the plenum 8 is injected in a spray through the discharge end 5 into the engine combustor area (not shown) as atomized droplets thoroughly mixed with compressed air flowing through the central conduit 9 and orifices 10.

Figure 2:
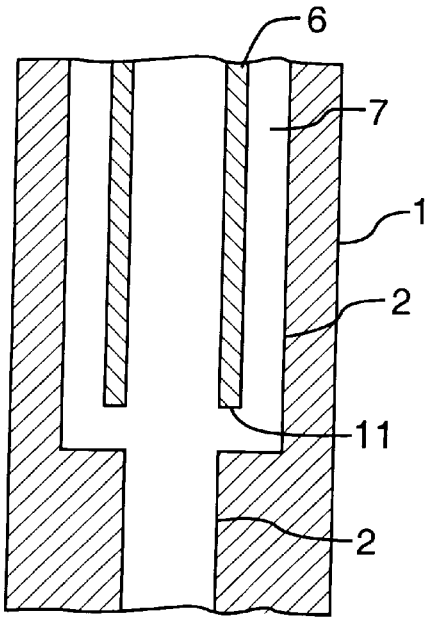
FIG.2 PRIOR ART
FIG. 2 is a detailed view of the end of the tubular internal heat shield illustrating the outward air-filled gap which serves as a thermal insulator to isolate the relatively cold fuel flowing through the internal heat shield from the fuel injector stem.

As illustrated in FIG. 2, at the inward end of the heat shield 6, the air-filled gap 7 is open to the fuel passage 2. The inward end 11 of the heat shield 6 must remain free of the fuel passage 2 at one end to permit thermally induced movement between the heat shield 6 and fuel passage 2.

Figure 3:
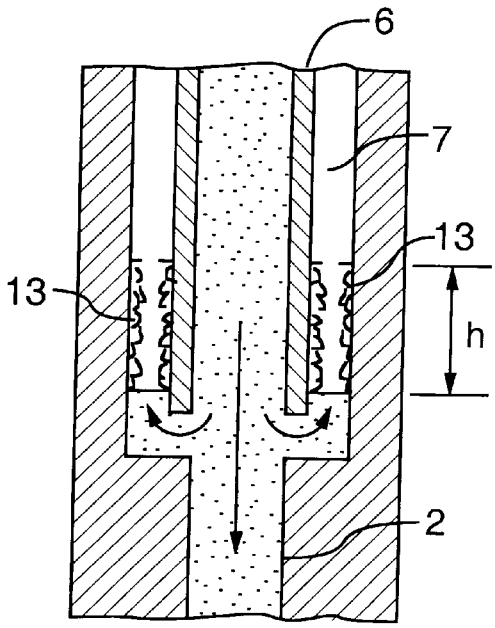
FIG.3 PRIOR ART
FIG. 3 is an illustration of the same section of the fuel injector stem showing the means by which coke is formed on the internal surfaces of the air-filled gap when fuel is injected under pressure through the fuel passage.

As shown in FIG. 3, when fuel 12 is injected under pressure through the fuel passage 2, the open space at the inward end 11 of the heat shield 6 permits fuel 12 to penetrate into the air filled gap 7 between the heat shield 6 and the fuel passage 2. Depending on the fuel pressure, which is controlled by the engine fuel control system, the level to which the fuel rises can vary as indicated in FIG. 3 by dimension "h". The air within the gap 7 compresses and decompresses depending on the fuel pressure.

As a result of the temperature gradient in the gap 7, the fuel in the gap is heated to a temperature where the fuel decomposes and forms a solid coke precipitant 13 on the adjacent walls of the fuel passage 2 and heat shield 6. However, when uncontrolled as in the prior art, the exact extent to which coke 13 is formed, when it is formed or if it is formed and the degree to which it adheres to the adjacent gap 7 surfaces is uncontrolled and essentially unknown.

The simple prior art coking of the gap 7 during initial operation of the engine has unpredictable results. Coke precipitant 13 may form loosely adherent particles that can be dislodged by the inward and outward motion of the fuel into the gap 7. As a result, coke particles may be flushed away from the area of formation into the orifices 14 of the injector tip 4. In addition, the area in which coke if formed (as indicated as "h" in FIG. 3) may not extend a sufficient distance to substantially impede the inward and outward flow of fuel.

Figure 5:
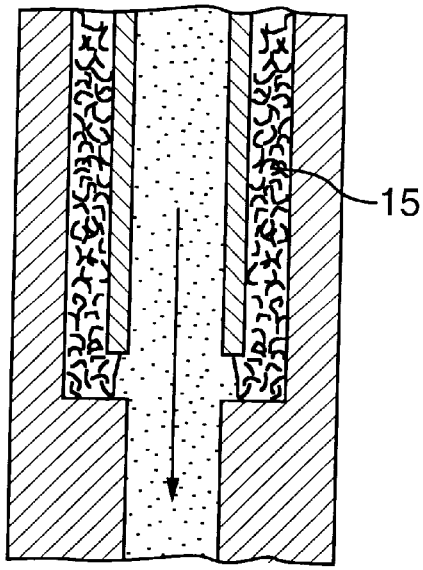
FIG. 5 shows a finished fuel injector stem treated according to the method of the invention wherein the air-filled gap includes a porous solid precipitant such as coke to physically impede the flow of fuel into the gap and to permit thermally induced movement between the heat shield and fuel passage while retaining the thermal insulating function.

Accordingly, the invention provides a method of forming a complete coke infill barrier 15 as indicated in FIG. 5. The coke is formed in a manner which is reproducable, predictable and can be optimized to suit the requirements of any injector or engine design.

Figure 4:
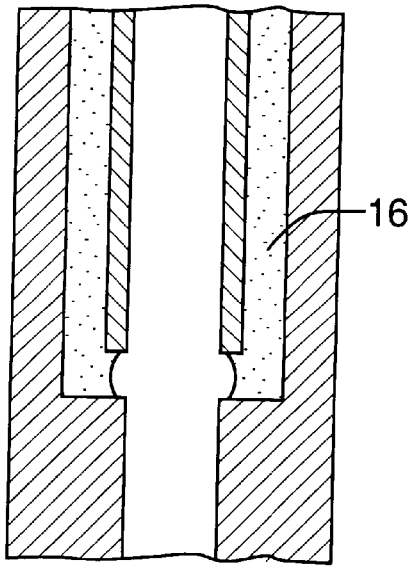
FIG. 4 illustrates a first step in the method according to the present invention where the annular gap is filled with a liquid, such as hydrocarbon fuel, prior to curing the liquid to form a precipitant that physically interferes with the movement of fuel and air within the gap.

With reference to FIG. 4, the method according to the invention includes initially filling an annular portion 16 of the gap 7 with a selected fluid, such as hydrocarbon fuel, for example. In order to fill the complete gap 7, it may be necessary to completely immerse the injector stem 1 in fuel in an inverted position to permit air in the gap to escape or alternatively, vent passages can be formed in the engine mount end 3 to vent off air trapped within the gap 7 when the gap 7 is filled with fuel.

The next step in the method is to cure the liquid to form a precipitant that remains physically and chemically stable at temperatures within the operating range for the injector stem 1. Various precipitant forming liquids will be known to those skilled in the art and it is unnecessary to restrict the invention to any particular liquid. However, hydrocarbon fuel is preferred since fuel cures with heat to form a coke precipitant. Coke is entirely compatible with the injector and the hydrocarbon fuel. The precipitant must also permit thermally induced movement between the heat shield 6 and fuel passage 2.

Coke is known to be stable once formed at temperatures within the operating range of the injector stem and the porous nature of coke permits relative movement while serving to impede the free flow of fuel into the insulating gap 7.

Once the fuel or other selected liquid is deposited in the gap 7 as indicated in FIG. 4, the fuel is heated by placing the entire fuel injector stem in an oven or by induction heating of the fuel injector stem by known methods. To prevent coke formation on the interior surfaces of the unshielded portions of the fuel passage 2, the internal passage of the heat shield 6 and other fuel conducting components of the injector tip 4, the fuel passage 2 is purged of fuel while the fuel is being heated. A convenient means of purging is to convey a continuous flow of cool dry air during the heating of the fuel in the gap 7.

In order to form coke, the fuel must be heated below its combustion temperature and therefore fuel should be heated to a temperature in the range of 100° C. to 150° C. To completely decompose the fuel and form an optimum amount of coke, the time period during which fuel is heated should be for a duration in the range of 20 to 120 minutes.

In order to determine the amount of precipitant deposited in the gap 7, various means of non-destructive testing can be used. The simplest method is to compare the weight of the fuel injector before and after filling with fuel and heating. However, unreacted liquid fuel also tends to obscure the results if the heat of the oven or time duration were inadequate to cure all fuel into coke. X-ray examination or ultrasonic imaging can also be used to determine the extent of coke formation.

In this manner, the formation of coke to impede fuel flow within air-filled gap 7 can be controlled and optimized through careful control of the entire process before installation in the gas turbine engine, including quality control and inspection after curing is complete.

Although the above description and accompanying drawings relate to a specific preferred embodiment as presently contemplated by the inventor, it will be understood that the invention in its broad aspect includes mechanical and functional equivalents of the elements described and illustrated.

The embodiments of the invention in which an exclusive property or privilege is claimed are defined as follows:

1. A method of inhibiting instability during operation of a gas turbine engine;

the engine including an elongate fuel injector having an injector stem with an internal fuel passage extending from an engine mount end to an injector tip at a discharge end, the stem including a tubular internal heat shield disposed within the fuel passage, the heat shield secured to the fuel passage adjacent the mount end of the stem and spaced inwardly from the fuel passage thus defining an elongate annular thermal insulating gap between the fuel passage and the heat shield, the method comprising:

filling an annular portion of the gap with a selected fluid;

curing the liquid to form a precipitant that remains physically and chemically stable at temperatures within an operating range for the injector stem and that permits relative thermally induced movement between the heat shield and the fuel passage.

2. A method according to claim 1 wherein the liquid is a hydrocarbon fuel and the curing step includes heating the fuel to form coke.

3. A method according to claim 2 wherein fuel is heated by placing the fuel injector stem in an oven.

4. A method according to claim 2 wherein fuel is heated by induction heating of the fuel injector stem.

5. A method according to claim 2 wherein the fuel passage is purged of fuel while the fuel is heated.

6. A method according to claim 5 wherein the fuel passage is purged with a continuous flow of cool dry air during heating of the fuel.

7. A method according to claim 2 wherein fuel is heated to a temperature in the range of 100° C. to 150° C.

8. A method according to claim 7 wherein fuel is heated for a time duration in the range of 20 to 120 minutes.

9. A method according to claim 1 including the step of determining the amount of precipitant deposited in the gap through non-destructive testing.

10. A method according to claim 9 wherein the nondestructive testing is selected from the group consisting of: weight comparisons before and after; x-ray examination; and ultrasonic imaging.

* * * * *